US005402938A

United States Patent [19]

Sweeney

[11] Patent Number: 5,402,938

[45] Date of Patent: Apr. 4, 1995

[54] FLUID AMPLIFIER WITH IMPROVED OPERATING RANGE USING TAPERED SHIM

[75] Inventor: Roy O. Sweeney, Cincinnati, Ohio

[73] Assignee: Exair Corporation, Cincinnati, Ohio

[21] Appl. No.: 123,558

[22] Filed: Sep. 17, 1993

[51] Int. Cl.[6] ..... B05B 1/34; B05B 7/00

[52] U.S. Cl. ..... 239/431; 239/434; 239/552; 239/DIG. 7

[58] Field of Search ..... 239/424.5, 426, 431, 239/434, 434.5, 552, 428.5, DIG. 7

[56] References Cited

U.S. PATENT DOCUMENTS

| | | | |
|---|---|---|---|
| 3,716,192 | 2/1973 | Hunter | 239/205 |
| 3,741,481 | 6/1973 | Bauer | 239/DIG. 7 X |
| 3,806,039 | 4/1974 | Mocarski | 293/417.3 |
| 3,880,354 | 4/1975 | Van Horn | 239/DIG. 7 X |
| 3,918,645 | 11/1975 | Mohler | 239/498 |
| 3,984,054 | 10/1976 | Frochaux | 239/424 |
| 3,985,302 | 10/1976 | Frochaux | 239/424 |
| 4,055,870 | 11/1977 | Furutsutsumi | 15/409 |
| 4,195,780 | 4/1980 | Inglis | 239/73 |
| 4,336,017 | 6/1982 | Desty | 239/DIG. 7 X |
| 4,385,728 | 5/1983 | Inglis et al. | 239/424 |
| 4,391,410 | 7/1983 | Smith | 239/498 |
| 4,401,626 | 8/1983 | Lewis | 422/151 |
| 4,446,695 | 5/1984 | Burtis | 239/DIG. 7 X |
| 4,448,354 | 5/1984 | Reznick et al. | 239/DIG. 7 X |
| 4,582,258 | 4/1986 | Olson | 239/498 |
| 4,732,559 | 3/1988 | Pearl, II et al. | 431/346 |
| 4,846,670 | 7/1989 | Pearl, II et al. | 431/346 |
| 4,925,106 | 5/1990 | Maas et al. | 239/333 |
| 5,119,863 | 6/1992 | Okesaku et al. | 139/435.4 |

*Primary Examiner*—Andres Kashnikow
*Assistant Examiner*—Lesley D. Morris
*Attorney, Agent, or Firm*—Frost & Jacobs

[57] ABSTRACT

An air amplifier is provided for use in pneumatic control systems that can operate over a wide range of flow and pressure characteristics, and can additionally operate against a back pressure. The air amplifier utilizes a tapered shim that causes the pressurized air to follow a Coanda profile over a wider range (and against a back pressure) than is possible when using only a slotted, non-tapered shim. The shim is ring-shaped with a planar surface and includes inwardly directed tangs that are cut-off to provide an open central area. Some or all of the tangs are tapered along either one or both sides of the tang.

32 Claims, 4 Drawing Sheets

FLUID AMPLIFIER WITH IMPROVED OPERATING RANGE USING TAPERED SHIM

TECHNICAL FIELD

The present invention relates generally to fluid operating equipment and is particularly directed to pneumatic control devices of the type which operate according to the Coanda principle. The invention is specifically disclosed as an air amplifier that operates over a wide range of flow and pressure characteristics, and can additionally operate against a back pressure.

BACKGROUND OF THE INVENTION

Nozzles which act as fluid amplifiers have been available in the past, some of which operate by using the Coanda effect. The Coanda effect is the tendency of a gas or liquid coming out of a jet to travel close to the wall contour even if the wall's direction of curvature is away from the jet's axis. One nozzle that uses the Coanda effect has been disclosed in U.S. Pat. No. 3,806,039 (by Mocarski), in which the nozzle has a through passageway in which the cross-sectional opening at the inlet is quite large, then tapers down to a much narrower cross-sectional area at the throat of the nozzle.

In the Mocarski nozzle, ambient fluid is introduced into the inlet at the large cross-sectional area. A pressurized fluid is introduced from the side of the nozzle into an annular passageway. The fluid is further directed into a slot which contains a washer or shim. The washer or shim has rectangular spokes that are directed inward, but terminate before reaching the center portion of the shim to allow an open area through which ambient fluid can pass through the nozzle without any restriction from the spoked washer. As the pressurized fluid enters the slot area, some of the fluid travels along the surface of the spoked washer forming a jet at the center portion of the washer where the spokes terminate. At that point, the pressurized fluid flow gives up velocity to induce mass flow of ambient fluid. This pulls fluid through the inlet at the large cross sectional area and it mixes with the pressurized air to exit at the discharge end.

The Mocarski nozzle controls its slot width precisely by the spoked washer's thickness. In addition, by controlling the ratio of blocked area to open area (where the washer has spokes or no spokes), the open area of the slotted washer is precisely controlled, which is important for controlling the pressurized fluid flow. Unfortunately, an air amplifier nozzle constructed according to Mocarski operates effectively at some air pressures and washer thicknesses, but at other air pressures and other washer thicknesses it is ineffective. In some circumstances, the pressurized air flow can blow out both ends (both the inlet and discharge ends) of the nozzle, or the pressurized air flow will not follow the Coanda profile to provide the proper performance as an air amplifier. In addition, at low compressed air supply pressures, the Mocarski nozzle has very little ability to work against a back pressure, which makes it ineffective for use in most air amplifier applications. At high compressed air supply pressures, the Mocarski nozzle can have its pressurized air flow blow out both ends and have little ability to work against a back pressure. It has been determined that the high velocity air flow through a nozzle constructed according to the Mocarski patent does not follow the Coanda profile because of entrainment of ambient air in areas of the nozzle where the ambient air flow is blocked, while no compressed air flow is available to overcome that problem.

SUMMARY OF THE INVENTION

Accordingly, it is a primary object of the present invention to provide a washer or shim that allows for a more effective and more efficient fluid amplifier nozzle using the Coanda effect throughout a greater operating range, including use in applications where there is back pressure.

It is another object of the present invention to provide a shim for a fluid amplifier nozzle by which the nozzle may be thicker with a greater opening for compressed air to be exhausted through, thereby not being as susceptible to being plugged with dirt in the compressed air.

It is a further object of the present invention to provide an improved shim for a fluid amplifier nozzle that provides a uniform fluid flow throughout the inside diameter of the nozzle's fluid passage.

Additional objects, advantages and other novel features of the invention will be set forth in part in the description that follows and in part will become apparent to those skilled in the art upon examination of the following or may be learned with the practice of the invention.

To achieve the foregoing and other objects, and in accordance with one aspect of the present invention, an improved shim or washer is provided for use in a fluid amplifier nozzle which allows the nozzle to work over various pressure and flow ranges while following the Coanda profile, and will additionally operate against a back pressure. The shim has an overall circular shape, with a number of spokes or tangs that are directed toward the center of the circular shape. The tangs are cut off so as to provide a large open area at the center of the shim, and in addition, the inner ends of the tangs are tapered on either one or both sides of some of the tangs. A combination of straight, cut-off rectangular tangs and tapered tangs is most effective in some ways, because it provides a good operating range for a fluid amplifying nozzle while also increasing the fluid flow through the nozzle. The tapered tangs provide consistent performance while using the Coanda effect for amplification, and the straight, cut-off tangs provide a jet of fluid to the center of the nozzle for greater fluid amplification and fluid flow.

Still other objects of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
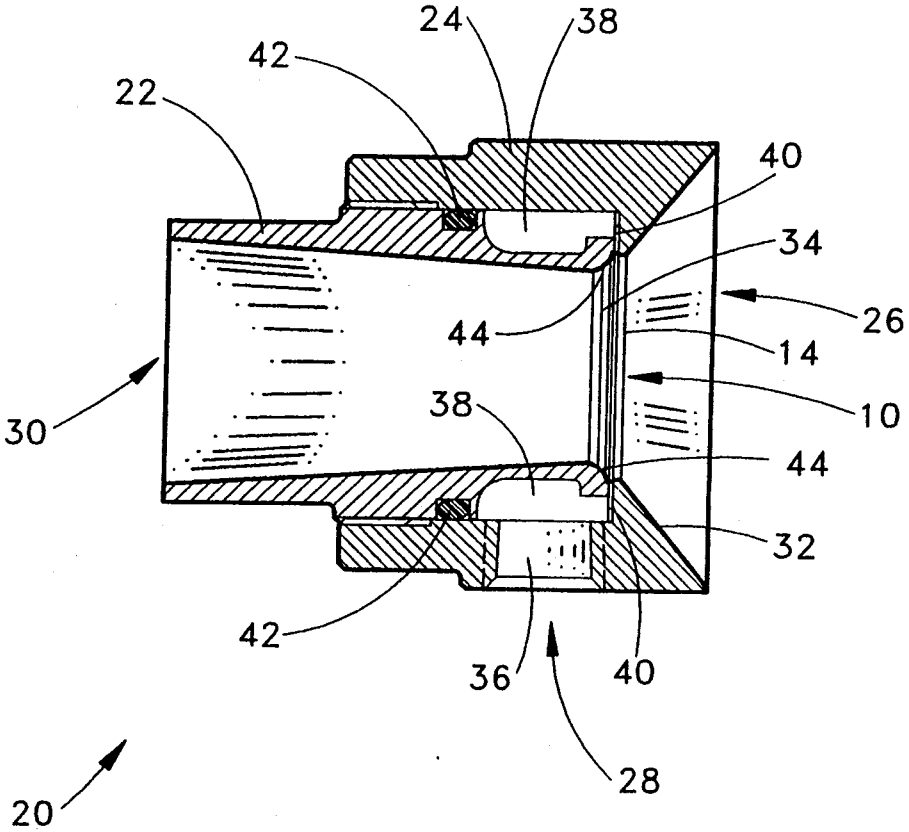
FIG. 1 is a side cross-sectional elevational view of a fluid amplifier constructed in accordance with the principles of the present invention.

Referring now to the drawings, FIG. 1 shows a fluid amplifier, generally designated by the index numeral 20, having two main parts, a plug 22 and a body 24. Fluid amplifier 20 is typically used with ambient air and pressurized air, and will hereinafter be referred to as an "air" amplifier. It will be understood that air amplifier 20 could be used with other types of fluids, including fuel-air mixtures.

Air amplifier 20 is typically used as a nozzle having an ambient air inlet 26, a pressurized air inlet 28, and a mixed air outlet 30. The ambient air that is pulled through inlet 26 is channelled through an annular mouth having a tapered surface 32, and further into a throat 34 at the narrowest portion of the air passage through air amplifier 20.

Pressurized air is introduced through an inlet conduit 36, into an annular chamber 38, and further directed through a passageway 40 where it is introduced into the ambient air. As can be seen in FIG. 1, inlet conduit 36 is part of the body 24, and annular chamber 38 is part of the plug 22. An O-ring 42 is used to seal the pressurized mating surfaces between plug 22 and body 24.

Figure 2:
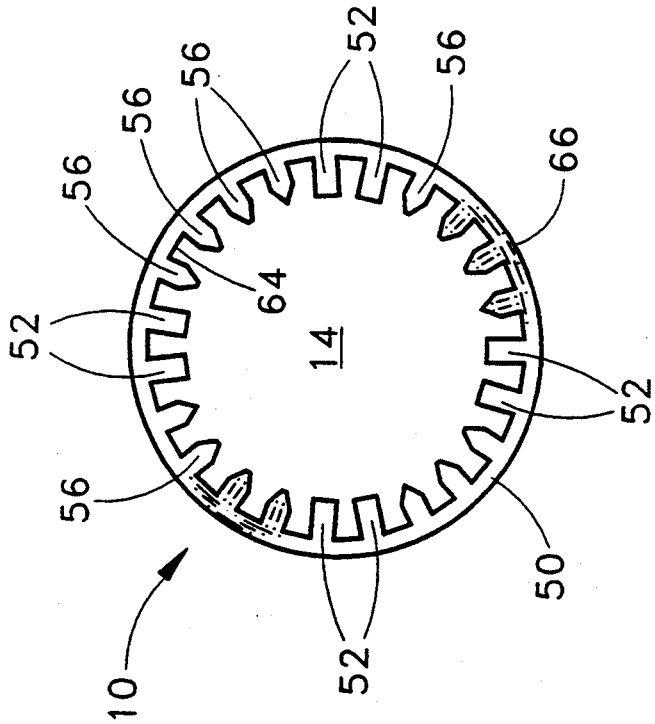
FIG. 2 is a front view of a slotted shim used in the fluid amplifier of FIG. 1.

The pressurized air that enters passageway 40 is directed through "nozzles" formed by the tangs of the shim. As best seen in FIG. 2, shim 10 includes a number of tangs which create a slotted appearance, and which are directed toward the center portion of shim 10. The tangs do not extend to the center of shim 10, but are cut off to create an open area 14. When pressurized air leaves passageway 40, it is exposed to ambient air flowing through ambient air inlet 26 and gives up velocity to induce mass flow of that ambient air. This pulls through large quantities of ambient air compared to the amount of pressurized air used, and the mixed airstream travels to the discharge end (outlet 30). Some of the pressurized air will follow the Coanda profile, generally designated by the index numeral 44, which is formed along the inner surfaces of plug 22 within throat 34 (see FIG. 7 for a more detailed description of Coanda profile 44).

Figure 3:
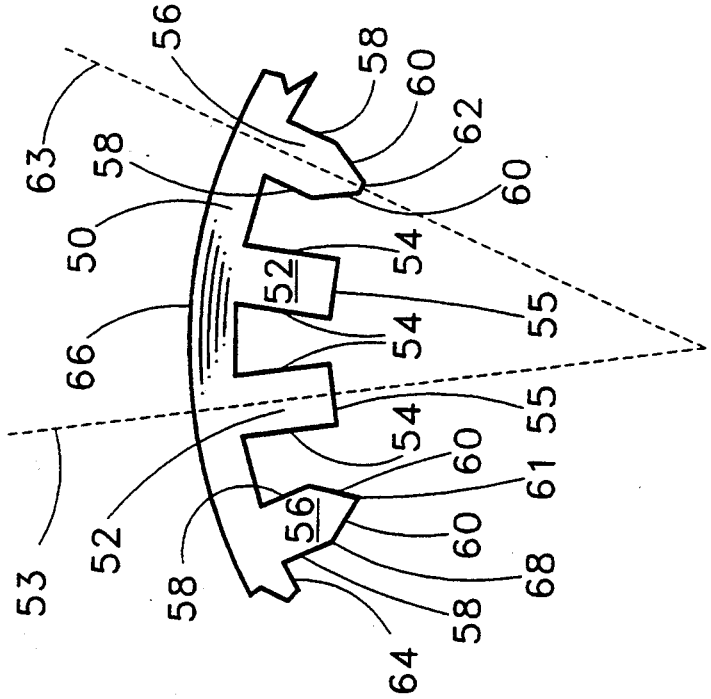
FIG. 3 is a magnified fractional view of a portion of the shim of FIG. 2.

Shim 10 has its outer portion defined by an annular ring 50, which is of a size and shape to be assembled between body 24 and the inlet end portion of plug 22 (as seen in FIG. 1). Shim 10 includes several tangs that are either rectangular or tapered. An example of a rectangular (non-tapered) tang is designated by index numeral 52, and has two (2) straight side edges 54 and an end edge 55. An example of a tapered tang is designated by index numeral 56, which has two (2) straight side edge half-portions 58, and two (2) tapered side edge half-portions 60. Tapered side edge half-portions 60 can either come to a point 61, or can terminate in a small end edge 62, as depicted in FIG. 3. Since tapered tang 56 has two (2) tapered side edge half-portions 60, it can be referred to as a "dual-tapered" tang.

In the area where a shim is straight (non-tapered), it produces a jet of air that shoots toward the center of air amplifier 20. In the area where the tangs are tapered and the nozzle expands in size (as compared to a nozzle formed by non-tapered tangs), the pressurized air spreads out and, at the end of passageway 40, attaches to the Coanda profile (along surfaces 104, 106, and 108—see FIG. 7) and changes direction approximately 90° where it reaches the throat 34, then further continuing to the discharge end (outlet 30).

The cut-off tangs allow for a greater air flow through air amplifier 20 through open area 14 of shim 10. Tapered tangs 56 are important features of the design of shim 10, since a shim comprising only rectangular tangs (such as tangs 52) will not work effectively against a back pressure and will not follow the Coanda profile when used in varying air pressure situations. Shim 10 provides improved performance because of its use of tapered tangs 56 which allow air amplifier 20 to operate against a back pressure and to operate over various pressure and flow ranges while still following the Coanda profile. When the pressurized air, exhausted from passageway 40, approaches the limits of the Coanda profile, instead of an intermittent flow occurring, tapered tangs 56 allow a continuous flow of air which observes the Coanda profile to be maintained throughout a greater range of flow and pressure conditions than has been possible in previous fluid or air amplifiers.

By using the improved shim 10, the air passages for the pressurized air, within plug 22 and body 24 of air amplifier 20 can be larger in size, because the pressurized air will still observe the Coanda profile as it flows over the surfaces of shim 10. These enlarged passages are an advantage because they are not as susceptible to being plugged by dirt particles in the compressed air. In addition, shim 10 also provides a uniform air flow through the throat 34 and throughout the inside diameter of the outlet passage 30 of air amplifier 20.

A combination of non-tapered tangs 52 and tapered tangs 56 is preferable in constructing shim 10, because it provides an increased pressure range having consistent performance while observing the Coanda profile and while also increasing the fluid flow rate through air amplifier 20. If a high flow rate is important in a particular application, then most of the tangs of shim 10 should be of the non-tapered type, such as tang 52. In this instance, the performance of air amplifier 20 is still improved even in the situation where only two (2) of the tangs of shim 10 are tapered (such as tang 56) while the remaining tangs are non-tapered (as in tang 52).

As depicted in FIG. 2, one preferred shim 10 has twenty-three (23) tangs, spaced equally apart from one another at 15.652° intervals. If only two (2) of the tangs were tapered, then twenty-one (21) of the tangs would be non-tapered tangs 52. The preferred dimensions for one embodiment of shim 10 are as follows: the outer diameter, taken along edge 66, is 1.371 inches (35 mm)±0.002 inches tolerance; the inner diameter of annular ring 50, generally depicted as an inner edge at index numeral 64, is 1.250 inches (32 mm); the diametrical dimension between end edges 55 and 62 of each of the tangs 52 or 56 is 1.0 inches (25 mm)±0.002 inches tolerance; and the diametrical dimension between the corner location designated by index numeral 68 (between the straight side edge half-portion 58 and the tapered side edge half-portion 60) is 1.112 inches (28 mm)±0.002 inches tolerance.

The width dimensions of the tangs themselves are preferably such that the gap between straight side edges 54 of rectangular tangs 52 at the end edge 55 is somewhat less than the length along end edge 55. The distance between straight side edges 54 of rectangular tang 52 is preferably constant (i.e., side edges 54 are parallel) along the length of rectangular tang 52 such that the gap between straight side edges 54 of two (2) adjacent rectangular tangs 52 is greater at the inner edge 64 of annular ring 50 than at the end edges 55 of those tangs. This configuration leads to a shape as shown in detail in FIG. 3. In addition, it is preferred that straight side edges 54 be parallel to the central axis, generally designated by the index numeral 53, of rectangular tang 52, and that central axis 53 intersect the center of a circle defined by the outer edge 66 of annular ring 50. Shim 10 will also be effective if the sides of adjacent tangs are parallel to one another-in this instance, the two sides of any one tang would not be parallel to each other.

The distance between the parallel straight side edge half-portions 58 of a tapered tang 56 are preferably equal to the distance between the parallel straight side edges 54 of a rectangular tang 52. In the example embodiment described above, this distance is preferably 0.078 inches (2 mm). The angle of taper formed by a tapered side edge half-portion 60 and an imaginary line defined by the continuation of the adjacent straight side edge half-portion 58 toward the center of shim 10 is preferably 30°. Furthermore, it is preferred that straight side edge half-portions 58 be parallel to the central axis, generally designated by the index numeral 63, of tapered tang 56, and that central axis 63 intersect the center of a circle defined by the outer edge 66 of annular ring 50.

As related above, as few as two (2) tapered tangs 56 can be used to improve the performance of air amplifier 20 when used in a shim 10 having twenty-three (23) total tangs. On the other hand, for lower air flow rates, it is preferred that a greater number of tapered tangs 56 be used in a particular shim 10, thereby reducing the number of rectangular tangs 52. It will be understood that the actual number of tangs used in a particular shim for a given application can vary as needed to properly perform in the required range of air flows and pressures, and against a back pressure. The improved performance of air amplifier 20 will be exhibited in all applications as long as at least two tapered tangs 56 are used in a particular shim 10. One preferred arrangement of tangs for shim 10 is depicted in FIG. 2 as a repeatable pattern of two (2) non-tapered rectangular tangs 52, followed by either three (3) or four (4) dual-tapered tangs 56, then back to another pair of non-tapered rectangular tangs 52.

Figure 4:
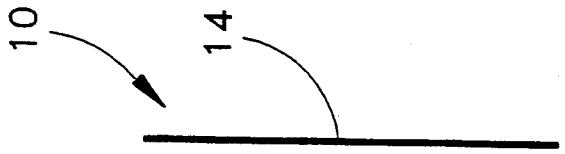
FIG. 4 is a side view of the shim of FIG. 2.

A side view of shim 10 is depicted in FIG. 4, in which shim 10 is essentially flat along its entire surface. Its thickness will depend upon the application shim 10 is to be used in. In an example application in which the pressurized air flow rate is 48 LPM (liters per minute), a pressure 50 PSI (pounds per square inch), and under a back pressure of 0.9 inches of water column, the shim thickness could be 0.002 inches (0.05 mm). The preferred material of shim 10 is stainless steel.

Figure 5:
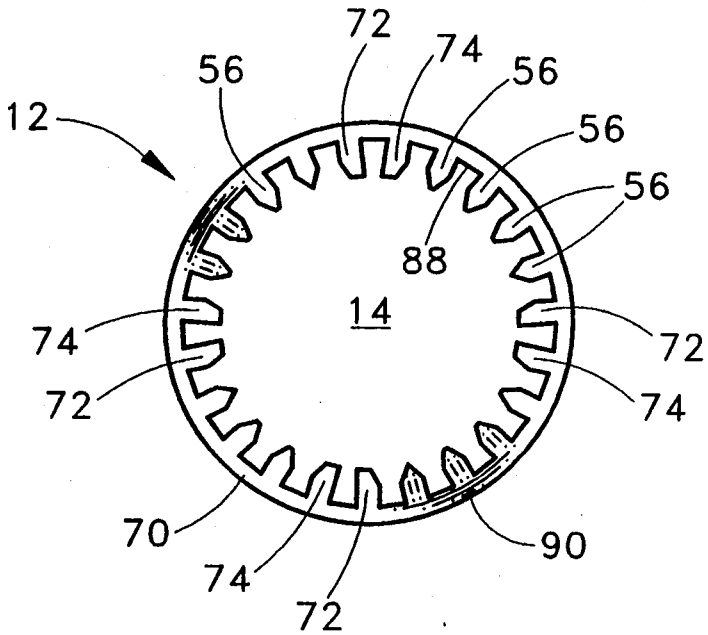
FIG. 5 is a front view of a second slotted shim used in the fluid amplifier of FIG. 1.

FIG. 5 depicts a second embodiment of a shim, generally designated by the index number 12, which is a variation of shim 10 described above. Shim 12 also causes air amplifier 20 to operate according to the Coanda profile, however, none of the tangs are non-tapered. In a similar manner to shim 10, shim 12 has an annular ring 70 to which all of the tangs are attached.

Figure 6:
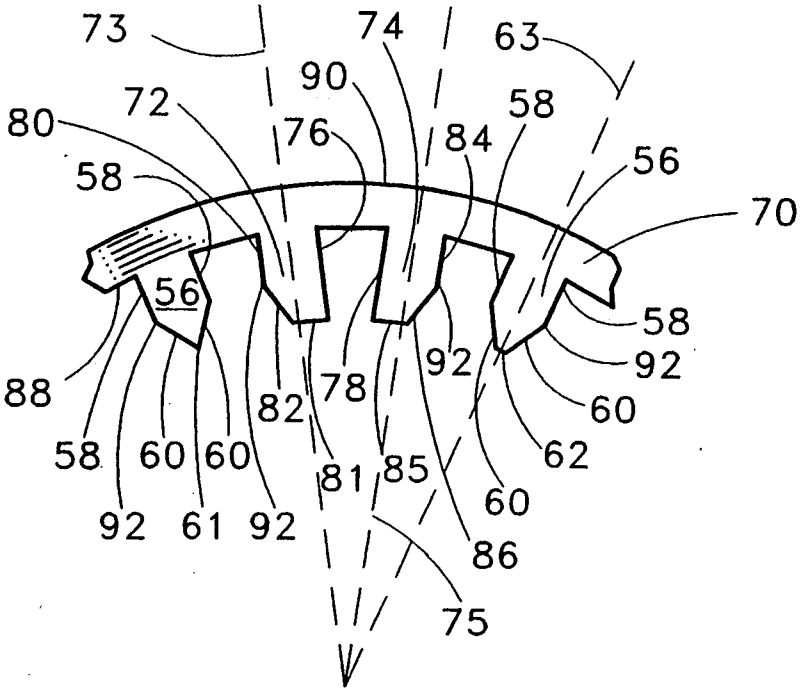
FIG. 6 is a magnified fractional view of a portion of the shim of FIG. 5.

Some of the tangs of shim 12 are tapered on both sides, as in the dual-tapered tangs 56. The remaining tangs, however, are straight on one side and tapered on the other, and can be referred to as "single-tapered" tangs. These tangs have a preferred orientation in which one each of these single-tapered tangs are placed between dual-tapered tangs 56 along the inner periphery of annular ring 70. Tang 72 is tapered on its left side only (as viewed in FIGS. 5 and 6) such that it has a straight side edge 76 along its right edge, and along its left edge it has a straight side edge half-portion 80 and a tapered side edge half-portion 82. The tapered side edge half-portion 82 terminates at an end edge 81. Tang 72 can be referred to as a "left-handed" single-tapered tang. In a similar fashion, tang 74 is tapered along its right side as viewed in FIGS. 5 and 6. Tang 74 has a straight side edge 78 along its left side, and along its right side it has a straight side edge half-portion 84 and a tapered side edge half-portion 86, which terminates in an end edge 85. Tang 74 can be referred to as a "right-handed" single-tapered tang.

Shim 12 also has an open area 14 at its center to allow for a relatively large air flow rate through air amplifier 20. The use of both dual-tapered tangs 56 and single-tapered tangs 72 and 74 provides a greater operating range in low air flow and air pressure applications, while still maintaining a Coanda profile. Shim 12 will also work against a back pressure, in a similar manner to that of shim 10.

In a given application in which the outer edge of annular ring 70, designated by index numeral 90, is 1.371 inches (35 mm) (having a preferred tolerance of ±0.002 inches), the other dimensions of shim 12 are very similar to those of shim 10. For example, the diameter across the inner edge 88 of annular ring 70 is preferably the same as the diameter across inner edge 64 of annular ring 50. In addition, the diametrical distance between end edges 62, 81, and 85 of the tangs in shim 12, and between end edges 55 and 62 of shim 10 are preferably the same distance. Further, the diametrical distance to the corner locations, designated by the index numeral 92, between the straight and tapered portions 58 and 60, 80 and 82, and 84 and 86 is the same as the diametrical distance between corner locations 68 of shim 10. It will be understood that larger diameter shims can be used in larger air amplifiers, and the thickness of the shims can vary depending upon the quality of the pressurized air to be used with a particular air amplifier and the magnitude of the pressure range of the pressurized air. It will be also understood that smaller diameter shims can be used in smaller air amplifiers, and the thickness of the shims can vary for the same reasons given above.

It is preferred that the straight side edge 76 and straight side edge half-portion 80 be parallel to one another and, in the second example embodiment described above, at a distance of 0.078 inches (2 mm), for single-tapered tang 72. For right-handed single-tapered tang 74, it is also preferred that the straight side edge 78 and straight side edge half-portion 84 be parallel to one another (at the same distance for the second example embodiment). In addition, it is preferred that the straight side edges 76 and 80 be parallel to the central axis 73 of left-handed single-tapered tang 72, and the straight edges 78 and 84 be parallel to the central axis 75 of right-handed single-tapered tang 74. In a similar manner to the configuration of shim 10, shim 12 will also be effective if the sides of adjacent tangs are parallel to one another—in this instance, the two sides of any one tang would not be parallel to each other.

One preferred arrangement of tangs for shim 12 is depicted in FIG. 5 as a repeating pattern of a left-handed single-tapered tang 72 and a right-handed single-tapered tang 74, followed by either three (3) or four (4) dual-tapered tangs 56, before arriving back to another pair of single-tapered tangs 72 and 74. For a particular application, the optimal shim 12 may also include a non-tapered tang 52. It will be understood that any combination of tapered and non-tapered tangs could be utilized in a shim design without departing from the principles of the present invention, including a shim in which all tangs are tapered (having no non-tapered tangs).

Figure 7:
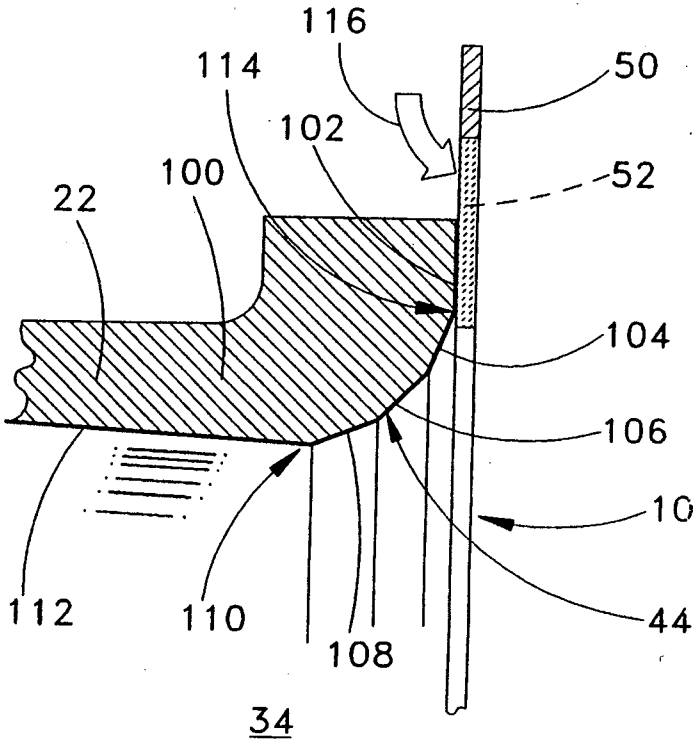
FIG. 7 is a magnified fractional view of the throat area of the plug portion of the fluid amplifier of FIG. 1, depicting in detail the Coanda profile.

The Coanda profile 44 is depicted in greater detail in FIG. 7, which shows the portion of plug 22 that is adjacent to shim 10 and within throat 34. The Coanda profile 44 is formed by surfaces 104, 106, and 108 of plug 22. Pressurized air (depicted by arrow 116) leaving passageway 40 is introduced between tangs of shim 10, and along surface 102. Any particular portion of surface 102 may or may not have pressurized air flowing over it, depending upon whether or not that portion is "blocked" by a tang of shim 10 (e.g., tang 52 on FIG. 7, depicted by a dashed cross-section). Since many portions of surface 102 have pressurized air flowing over them (between tangs, thereby forming nozzles), surface 102 is preferably scratch-free so air may smoothly flow over the surface. Pressurized air that flows along surface 102 will also flow along surfaces 104, 106, and 108 (in that order) due to the Coanda principle. Such air is "turned" at throat 34 by 90° from its initial direction as it exited passageway 40. This air is now aimed at the outlet 30 of air amplifier 20, and will further flow along surface 112.

In conjunction with the example preferred dimensions of shim 10 given hereinabove, the point indicated at index numeral 110 is at a throat diameter of 0.840" (21 mm), and also is located at the point where the direction of pressurized air flow is turned by 90°. The point indicated at index numeral 114 is at a throat diameter of 1.022" (26 mm), and also is located at the point where the direction of pressurized air flow is still travelling at a direction 0° with respect to its initial direction as it exits passageway 40. Surface 102 is preferably 0.060" (1.5 mm) across (its vertical length in FIG. 7). Surface 104 is angled at 22.5° with respect to surface 102, and is a flat area that is 0.045" (1 mm) long (as seen in FIG. 7). Surface 106 is angled at 45° with respect to surface 102, and is a flat area that is 0.045" (1 mm) long (as seen in FIG. 7). Surface 108 is angled at 67.5° with respect to surface 102, and is a flat area that is 0.045" (1 mm) long (as seen in FIG. 7). Surface 112 is angled at 93.5° with respect to surface 102.

Figure 9:
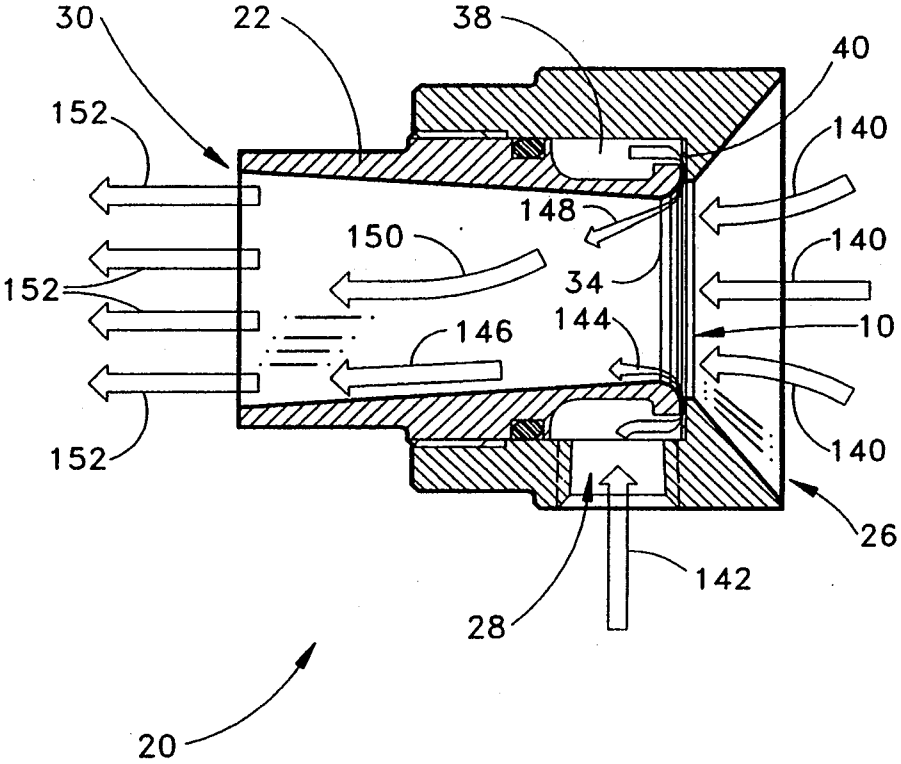
FIG. 9 is a side cross-sectional elevational view of the fluid amplifier of FIG. 1, showing the fluid flow paths through the fluid amplifier.
Figure 8:
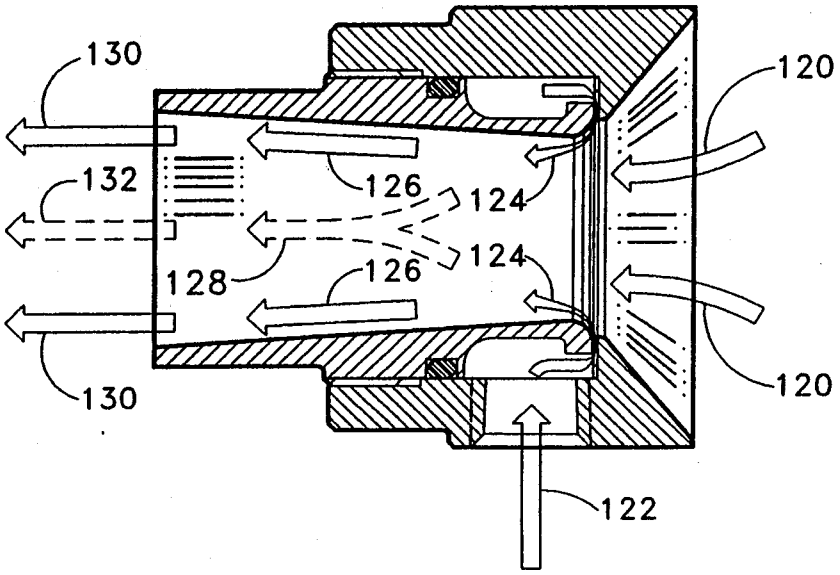
(PRIOR ART) FIG. 8
FIG. 8 is a side cross-sectional elevational view of a prior art fluid amplifier, showing the fluid flow paths through the prior art fluid amplifier.

The effects of shim 10 on air flow are described in detail in conjunction with FIGS. 8 and 9. FIG. 8 depicts an air amplifier of the conventional type either having no shim at all, or having a shim which is comprised solely of "square" tangs (similar to the non-tapered tangs 52 of shim 10). Entrained air enters at the ambient air inlet while following flow paths indicated by arrows 120. Pressurized air enters at the pressurized air inlet while following a flow path indicated by arrow 122.

In the configuration where there is no shim, the pressurized air travels through the annular chamber and passageway before entering the throat, following flow paths 124. The pressurized air mixes with the entrained ambient air, and follows flow paths within the plug indicated by arrows 126, around the annular inner diameter of the throat. The mixed air exits the air amplifier at its outlet while following flow paths 130. The air flow in the center portion of the outlet, indicated by the dashed arrow 132, is travelling at a relatively low velocity because most of the pressurized air has followed the Coanda profile, and has entrained ambient air only around the annular inner diameter of the throat. The center portion of the air amplifier, therefore, is not contributing any significant air volume to the overall air flow of the air amplifier.

In the configuration where there is a shim having square tangs, the pressurized air travels through the annular chamber and passageway before entering the throat, following flow paths 124. The pressurized air mixes with the entrained ambient air, and, due to the square, non-tapered tangs of the shim, mostly follows flow paths within the plug indicated by the dashed arrow 128, in the center portions of the throat. The mixed air exits the air amplifier's outlet while following flow path 132 (depicted by a dashed arrow). The air flow around the annular inner diameter of the throat (given by arrows 126) is travelling at a relatively low velocity because most of the pressurized air has not followed the Coanda profile, and has entrained ambient air only around the center portions of the throat. The center portion of the air amplifier, therefore, is contributing most of the air volume to the overall air flow of the air amplifier. In effect, there is a "spike" of air flow travelling through the center of the outlet. The air flow at the annular inner diameter portion of the outlet, indicated by arrows 130 is not contributing any significant air volume to the overall air flow of the air amplifier.

FIG. 9 depicts air amplifier 20, and includes a shim 10 having both dual-tapered tangs 56 and non-tapered tangs 52. Entrained air enters at ambient air inlet 26 while following flow paths indicated by arrows 140. Pressurized air enters at pressurized air inlet 28 while following a flow path indicated by arrow 142. The pressurized air travels through annular chamber 38 and passageway 40 before entering throat 34, following flow paths 144 and 148. The pressurized air mixes with the entrained ambient air, and follows flow paths within plug 22 indicated by arrows 146 and 150. The mixed air exits the air amplifier at its outlet while following flow paths indicated by arrows 152.

The pressurized air flow path 144 has flowed past a tapered tang 56, and follows the Coanda profile 44 of plug 22. On the other side of the throat, the pressurized air flow path 148 has flowed past a non-tapered tang 52, and does not follow the Coanda profile 44, but instead is directed toward the center portions of the plug 22. The pressurized air following flow path 144 is mixed with entrained ambient air (following flow paths 140) and follows a flow path indicated by arrow 146 within plug 22. The pressurized air following flow path 148 is mixed with entrained ambient air (following flow paths 140) and follows a flow path indicated by arrow 150 within plug 22.

The difference in flow paths is readily apparent when comparing FIG. 9 to FIG. 8. Because of the combination of tapered and non-tapered tangs 56 and 52, respectively, more ambient air is entrained by the air amplifier 20 of the present invention and made to flow through the throat 34. As a result, a relatively uniform velocity profile is achieved across the cross-sectional diameter at outlet 30, thereby providing a more constant velocity of mixed air at outlet 30. In addition, the air amplifier 20 of FIG. 9 will operate at greater variations in air flow and pressure, and will work against a back pressure.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A shim used in a fluid amplifier of the type that operates according to the Coanda principle, said fluid amplifier having an ambient fluid inlet, a pressurized fluid inlet, a Coanda profile, a throat, and a mixed fluid outlet, said shim comprising a thin planar member having an outer annular ring portion having inner and outer edges, said ring portion having a plurality of integral tangs extending radially inwardly from said inner edge of the ring portion, said plurality of tangs being cut-off thereby defining a central open area at the center of said shim, at least two of said tangs being tapered wherein some of said tapered tangs are dual-tapered tangs and others are single-tapered tangs, and a portion at least of said pressurized fluid being directed along an annular passageway between the tangs of said shim in said passageway to a Coanda profile that turns the pressurized fluid to a throat as it is mixed with the ambient fluid.

2. The shim as recited in claim 1, wherein said dual-tapered tangs are each bounded by a first straight side-edge having first and second ends, said first end of said first straight side-edge being connected to the inner edge of said ring portion; a first tapered side-edge having first and second ends, said first end of said first tapered side-edge being connected to the second end of said first straight side-edge; a short end edge having first and second ends, said first end of said short end edge being connected to the second end of said first tapered side-edge; a second tapered side-edge having first and second ends, said first end of said second tapered side-edge being connected to the second end of said end edge, thereby substantially forming a point; a second straight side-edge having first and second ends, said first end of said second straight side-edge being connected to the second end of said second tapered side-edge, and said second end being connected to the inner edge of said ring portion.

3. The shim as recited in claim 2, wherein each of said dual-tapered tangs has a central axis extending through the inner edge of said ring portion and through said end edge, said end edge is perpendicular to said central axis, and said first and second straight side-edges are each parallel to said central axis.

4. The shim as recited in claim 3, wherein said central axis intersects the center of a circle defined by the outer edge of the outer annular ring of said shim.

5. The shim as recited in claim 2, wherein each of said dual-tapered tangs is of equal length from its end edge to the inner edge of said ring portion.

6. The shim as recited in claim 1, wherein said dual-tapered tangs are each bounded by a first straight side-edge having first and second ends, said first end of said first straight side-edge being connected to the inner edge of said ring portion; a first tapered side-edge having first and second ends, said first end of said first tapered side-edge being connected to the second end of said first straight side-edge; a second tapered side-edge having first and second ends, said first end of said second tapered side-edge being connected to the second end of said first tapered side-edge thereby forming a point; a second straight side-edge having first and second ends, said first end of said second straight side-edge being connected to the second end of said second tapered side-edge, and said second end being connected to the inner edge of said ring portion.

7. The shim as recited in claim 6, wherein each of said dual-tapered tangs has a central axis extending through the inner edge of said ring portion and through said point, and said first and second straight side-edges are each parallel to said central axis.

8. The shim as recited in claim 7, wherein said central axis intersects the center of a circle defined by the outer edge of the outer annular ring of said shim.

9. The shim as recited in claim 6, wherein each of said dual-tapered tangs is of equal length from its point to the inner edge of said ring portion.

10. The shim as recited in claim 1, wherein said single-tapered tangs are each bounded by a first straight side-edge having first and second ends, said first end of said first straight side-edge being connected to the inner edge of said ring portion; a first tapered side-edge having first and second ends, said first end of said first tapered side-edge being connected to the second end of said first straight side-edge; an end edge having first and second ends, said first end of said end edge being connected to the second end of said first tapered side-edge; a second straight side-edge having first and second ends, said first end of said second straight side-edge being connected to the second end of said end edge, and said second end being connected to the inner edge of said ring portion.

11. The shim as recited in claim 10, wherein each of said single-tapered tangs has a central axis extending through the inner edge of said ring portion, said end edge is perpendicular to said central axis, and said first and second straight side-edges are each parallel to said central axis.

12. The shim as recited in claim 11, wherein said central axis intersects the center of a circle defined by the outer edge of the outer annular ring of said shim.

13. The shim as recited in claim 10, wherein each of said single-tapered tangs are of equal length from its end edge to the inner edge of said ring portion.

14. The shim as recited in claim 1, wherein some of the single-tapered tangs are left-handed and others are right-handed.

15. The shim as recited in claim 14, wherein said tangs are configured in arepeatable pattern comprising: a first plurality of dual-tapered tangs, a left-handed single-tapered tang, a right-handed single-tapered tang, and repeating with a second plurality of dual-tapered tangs.

16. The shim as recited in claim 1, wherein said tangs are spaced apart equidistant from one another around the periphery of the inner edge of said ring portion.

17. A shim used in a fluid amplifier of the type that operates according to the Coanda principle, said fluid amplifier having an ambient fluid inlet, a pressurized fluid inlet, a Coanda profile, a throat, and a mixed fluid outlet, said shim comprising a thin planar member having an outer annular ring portion having inner and outer edges, said ring portion having a plurality of integral tangs extending radially inwardly from said inner edge of the ring portion, said plurality of tangs being cut-off thereby defining a central open area at the center of said shim, at least two of said tangs being tapered wherein some of said tapered tangs are dual-tapered tangs and others are single-tapered tangs, the remaining tangs being non-tapered, and a portion at least of said pressurized fluid being directed along an annular passageway between the tangs of said shim in said passageway to a Coanda profile-that turns the pressurized fluid to a throat as it is mixed with the ambient fluid.

18. The shim as recited in claim 17, wherein said tangs are spaced apart equidistant from one another around the periphery of the inner edge of said ring portion.

19. The shim as recited in claim 17, wherein some of the single-tapered tangs are left-handed and others are right-handed.

20. A fluid amplifier of the type that operates according to the Coanda principle, said fluid amplifier comprising:

(a) an ambient fluid inlet;
(b) a pressurized fluid inlet;
(c) an annular passageway in communication with said pressurized fluid inlet;
(d) an annular throat in communication with said ambient fluid inlet and said annular passageway, said annular throat including a Coanda profile;
(e) a mixed fluid outlet in communication with said annular throat; and
(f) a shim positioned in said annular throat, said shim comprising a thin planar member having an outer annular ring portion having inner and .outer edges, said ring portion having a plurality of integral tangs extending radially inwardly from said inner edge of the ring portion, said plurality of tangs being cut-off thereby defining a central open area at the center of said shim, and at least two of said tangs being tapered wherein some of said tapered tangs are dual-tapered tangs and others are single-tapered tangs, whereby said fluid flowing through said pressurized inlet is directed along said annular passageway and a portion at least is directed between the tangs of said shim to a Coanda profile, where said fluid mixes with fluid flowing through said ambient fluid inlet, thereby providing a fluid amplification effect.

21. The fluid amplifier as recited in claim 20, wherein some of said single-tapered tangs are left-handed and others are right-handed.

22. The fluid amplifier as recited in claim 21, wherein said tangs are configured in a repeatable pattern comprising: a first plurality of dual-tapered tangs, a left-handed single-tapered tang, a right-handed single-tapered tang, and repeating with a second plurality of dual-tapered tangs.

23. A shim used in a fluid amplifier of the type that operates according to the Coanda principle, said fluid amplifier having an ambient fluid inlet, a pressurized fluid inlet, a Coanda profile, a throat, and a mixed fluid outlet, said shim comprising a thin planar member having an outer annular ring portion having inner and outer edges, said ring portion having a plurality of integral tangs extending radially inwardly from said inner edge of the ring portion, said plurality of tangs being cut-off thereby defining a central open area at the center of said shim, at least two of said tangs being dual-tapered that end substantially in a point, and a portion at least of said pressurized fluid being directed along an annular passageway between the tangs of said shim in said passageway to a Coanda profile that turns the pressurized fluid to a throat as it is mixed with the ambient fluid.

24. The shim as recited in claim 23, wherein said tangs are configured in a repeatable pattern comprising: a first plurality of dual-tapered tangs, a first non-tapered tang, a second non-tapered tang, and repeating with a second plurality of dual-tapered tangs.

25. The shim as recited in claim 23, wherein said dual-tapered tangs are each bounded by a first straight side-edge having first and second ends, said first end of said first straight side-edge being connected to the inner edge of said ring portion; a first tapered side-edge having first and second ends, said first end of said first tapered side-edge being connected to the second end of said first straight side-edge; a short end edge having first and second ends, said first end of said short end edge being connected to the second end of said first tapered side-edge; a second tapered side-edge having first and second ends, said first end of said second tapered side-edge being connected to the second end of said end edge, thereby substantially forming a point; a second straight side-edge having first and second ends, said first end of said second straight side-edge being connected to the second end of said second tapered side-edge, and said second end being connected to the inner edge of said ring portion.

26. The shim as recited in claim 23, wherein said dual-tapered tangs are each bounded by a first straight side-edge having first and second ends, said first end of said first straight side-edge being connected to the inner edge of said ring portion; a first tapered side-edge having first and second ends, said first end of said first tapered side-edge being connected to the second end of said first straight side-edge; a second tapered side-edge having first and second ends, said first end of said second tapered side-edge being connected to the second end of said first tapered side-edge thereby forming a point; a second straight side-edge having first and second ends, said first end of said second straight side-edge being connected to the second end of said second tapered side-edge, and said second end being connected to the inner edge of said ring portion.

27. A shim used in a fluid amplifier of the type that operates according to the Coanda principle, said fluid amplifier having an ambient fluid inlet, a pressurized fluid inlet, a Coanda profile, a throat, and a mixed fluid outlet, said shim comprising a thin planar member having an outer annular ring portion having inner and outer edges, said ring portion having a plurality of integral tangs extending radially inwardly from said inner edge of the ring portion, said plurality of tangs being cut-off thereby defining a central open area at the center of said shim, at least two of said tangs being dual-tapered that end substantially in a point, the remaining tangs being non-tapered, and a portion at least of said pressurized fluid being directed along an annular passageway between the tangs of said shim in said passageway to a Coanda profile that turns the pressurized fluid to a throat as it is mixed with the ambient fluid.

28. The shim as recited in claim 27, wherein said tangs are configured in a repeatable pattern comprising: a first plurality of dual-tapered tangs, a first non-tapered tang, a second non-tapered tang, and repeating with a second plurality of dual-tapered tangs.

29. A fluid amplifier of the type that operates according to the Coanda principle, said fluid amplifier comprising:

(a) an ambient fluid inlet;

(b) a pressurized fluid inlet;

(c) an annular passageway in communication with said pressurized fluid inlet;

(d) an annular throat in communication with said ambient fluid inlet and said annular passageway, said annular throat including a Coanda profile;

(e) a mixed fluid outlet in communication with said annular throat; and (f) a shim positioned in said annular throat, said shim comprising a thin planar member having an outer annular ring portion having inner and outer edges, said ring portion having a plurality of integral tangs extending radially inwardly from said inner edge of the ring portion, said plurality of tangs being cut-off thereby defining a central open area at the center of said shim, and at least two of said tangs being dual-tapered that end substantially in a point, whereby said fluid flowing through said pressurized inlet is directed along said annular passageway and a portion at least is directed between the tangs of said shim to a Coanda profile, where said fluid mixes with fluid flowing through said ambient fluid inlet, thereby providing a fluid amplification effect.

30. The fluid amplifier as recited in claim 20, wherein some of said tangs are dual-tapered tangs and the other of said tangs are non-tapered tangs.

31. The fluid amplifier as recited in claim 30, wherein said tangs are configured in a repeatable pattern comprising: a first plurality of dual-tapered tangs, a first non-tapered tang, a second non-tapered tang, and repeating with a second plurality of dual-tapered tangs.

32. The fluid amplifier as recited in claim 29, wherein said tangs are configured in a repeatable pattern comprising: a first plurality of dual-tapered tangs, a first non-tapered tang, a second non-tapered tang, and repeating with a second plurality of dual-tapered tangs.

* * * * *

UNITED STATES PATENT AND TRADEMARK OFFICE

CERTIFICATE OF CORRECTION

PATENT NO. : 5,402,938

DATED : April 4, 1995

INVENTOR(S) : Roy O. Sweeney

It is certified that error appears in the above-indentified patent and that said Letters Patent is hereby corrected as shown below:

Column 11, line 5 (claim 15), "arepeatable" should read --a repeatable--.

Column 14, line 16 (claim 30), delete "20" and insert therefor --29--.

Signed and Sealed this

Nineteenth Day of December, 1995

*Attest:*

Bruce Lehman

BRUCE LEHMAN

*Attesting Officer*

*Commissioner of Patents and Trademarks*